US010083580B2

(12) United States Patent
Cho

(10) Patent No.: US 10,083,580 B2
(45) Date of Patent: Sep. 25, 2018

(54) PASSENGER EVACUATION DIRECTION GUIDANCE SYSTEM

(71) Applicant: GAONCOS CO., LTD., Goyang-si (KR)

(72) Inventor: Hyun Bo Cho, Ansan-si (KR)

(73) Assignees: GOTEC INC., Seongnam-si (KR); Cho Hyun Bo, Ansan-si (KR)

( * ) Notice: Subject to any disclaimer, the term of this patent is extended or adjusted under 35 U.S.C. 154(b) by 0 days.

(21) Appl. No.: 15/509,058

(22) PCT Filed: Sep. 4, 2015

(86) PCT No.: PCT/KR2015/009377
§ 371 (c)(1),
(2) Date: Mar. 6, 2017

(87) PCT Pub. No.: WO2016/036208
PCT Pub. Date: Mar. 10, 2016

(65) Prior Publication Data

US 2017/0263088 A1 Sep. 14, 2017

(30) Foreign Application Priority Data

Sep. 5, 2014 (KR) ..... 10-2014-0118877

(51) Int. Cl.
*G08B 7/06* (2006.01)

(52) U.S. Cl.
CPC ..... *G08B 7/066* (2013.01); *G08B 7/062* (2013.01)

(58) Field of Classification Search
CPC ..... G08B 7/066; G08B 7/062
(Continued)

(56) References Cited

U.S. PATENT DOCUMENTS 6,150,943 A * 11/2000 Lehman ..... G08B 7/062 340/332
9,911,340 B2 * 3/2018 Samarasekera ..... G08G 5/0069
(Continued)

FOREIGN PATENT DOCUMENTS

KR 100547919 2/2006
KR 1020110059161 6/2011
(Continued)

OTHER PUBLICATIONS

International Search Report—PCT/KR2015/009377 dated Jan. 7, 2016.

*Primary Examiner* — Hirdepal Singh
(74) *Attorney, Agent, or Firm* — Cantor Colburn LLP

(57) ABSTRACT

Provided is a passenger evacuation direction guidance system, and particularly, a passenger evacuation direction guidance system capable of easily evacuating passengers to a safe place from a disaster or an accident occurring during a train service, and including an emergency situation detection unit which determines the occurrence of a disaster or an accident on a traveling route of a train, an evacuation direction generation unit which receives an emergency situation detection signal in respect to the occurrence of a disaster or an accident from the emergency situation detection unit, and generates passenger evacuation direction information at a disaster or accident occurrence point, and an evacuation direction control unit which receives the passenger evacuation direction information generated by the evacuation direction generation unit, and provides a passenger evacuation direction to the passengers.

8 Claims, 5 Drawing Sheets

(58) Field of Classification Search
USPC ..... 340/540
See application file for complete search history.

(56) References Cited

U.S. PATENT DOCUMENTS

| | | | | |
|---|---|---|---|---|
| 2009/0151210 | A1 | 6/2009 | Nagatome | |
| 2010/0193633 | A1* | 8/2010 | Budinger | B64C 1/18 244/118.5 |
| 2011/0007280 | A1* | 1/2011 | Patterson | F21S 6/001 353/12 |
| 2011/0084830 | A1* | 4/2011 | Kang | G08B 7/062 340/524 |
| 2014/0009274 | A1* | 1/2014 | Kohlmeier-Beckmann | A62B 3/00 340/425.5 |

FOREIGN PATENT DOCUMENTS

| | | | | |
|---|---|---|---|---|
| KR | 1020130062067 | | | 6/2013 |
| KR | 20130109349 | A | * | 10/2013 |
| KR | 1020130109349 | | | 10/2013 |
| KR | 1020140073612 | | | 6/2014 |

* cited by examiner (a)

(b)

PASSENGER EVACUATION DIRECTION GUIDANCE SYSTEM

TECHNICAL FIELD

The present invention relates to a passenger evacuation direction guidance system, and particularly, to a passenger evacuation direction guidance system capable of easily evacuating passengers to a safe place from a disaster or an accident occurring during a train service.

BACKGROUND ART

Trains, including subway trains or railway trains, have been operated as an alternative for solving traffic congestion in metropolitan areas, and subway or railway lines have been consistently extended.

Because the train travels in tunnels, which are underground spaces, for a long period of time, and travels often at night, there is a need for a guidance system for safely evacuating passengers from a disaster or an accident occurring in the tunnel or on a traveling route.

Furthermore, because it is difficult for the passengers to ensure visibility at night or at a dark place such as a tunnel where light does not enter from the outside, the passengers cannot recognize an evacuation route to a safe place, and as a result, an importance of the guidance system is further emphasized.

In the related art, emergency exit lamps are just installed in the tunnel, thereby guiding the passengers to a safe place from a disaster and an accident.

However, the method causes the passengers to suffer from a difficulty in finding the emergency exit guide lamps in an urgent situation, and the passenger cannot recognize a direction that guides the passengers to a place closest to the emergency exit from the current positions of the passengers, and as a result, there is a problem in that it is impossible to efficiently evacuate the passengers to the safe place.

Moreover, because due to the structure of the train, evacuation directions, in which the passengers exit through a plurality of doors, are different in accordance with a disaster or accident occurrence point, there is a limitation in informing the passengers, who exit through doors of a subway train or a railway train, of the evacuation direction only by using guide light such as the emergency exit guide lamps, and seriously, there is a problem in that a loss of life may be increased due to misjudgments of the passengers.

Therefore, the present applicant has developed the present invention in order to solve the above problems, and as literature of related art, there is Korean Patent No. 10-0547919 (entitled 'Emergency Escape Guide Apparatus').

DISCLOSURE

Technical Problem

The present invention has been made in an effort to solve the above problems, and an object of the present invention is to provide an evacuation direction guidance system capable of efficiently informing passengers, who exit through each door of a train, of an evacuation direction when a disaster or an accident occurs on a traveling route of the train.

Technical Solution

The present invention includes: an evacuation direction generation unit which generates passenger evacuation direction information for passengers in a train when a disaster or an accident occurs on a traveling route of the train; and an evacuation direction display unit which receives the passenger evacuation direction information generated by the evacuation direction generation unit, and displays a passenger evacuation direction on an object positioned at the periphery of the train.

In addition, the object may be at least one of a wall surface, a floor surface, and a ceiling surface positioned at the periphery of the train.

In addition, the evacuation direction display unit may include an evacuation direction indicating module which is installed on the train so as to be moved together with the train and indicates the passenger evacuation direction on the object by emitting light toward the object.

In addition, the evacuation direction indicating module may be installed on a door of the train or at a position adjacent to the door.

In addition, the evacuation direction display unit may further include an angle adjusting module which adjusts an indication angle of the evacuation direction indicating module in accordance with a position of the object.

In addition, the evacuation direction display unit may further include an object detection module for detecting a position of the object.

The evacuation direction display unit may further include a focal point adjusting module which calculates a focal length between the object and the evacuation direction indicating module based on the position of the object detected by the object detection module, and adjusts clarity of the indication of the passenger evacuation direction.

In addition, the passenger evacuation direction may be indicated by an arrow indicating the evacuation direction or a route map indicating an evacuation route from the current positions of the passengers to a safe place.

In addition, the evacuation direction display unit may further include a voice output module which informs the passengers of the position of the object by voice, and the voice output module may inform the passengers of the passenger evacuation direction by voice when there is no object on which the passenger evacuation direction is indicated or when the object is not appropriate.

In addition, the order of the objects to be detected by the object detection module may be determined according to the ability of the object of enabling the passengers to easily recognize the passenger evacuation direction indicated by the evacuation direction indicating module when the passengers in the train exit through the doors to the outside of the train, and a wall surface, a floor surface, and a ceiling surface may be determined in priority order.

Advantageous Effects

According to the present invention, it is possible to quickly provide a safe evacuation route to the passengers who exit through the doors of the train when a disaster or an accident occurs on a traveling route of the train.

In addition, according to the present invention, the evacuation direction control unit is provided at each of the doors through which the passengers exit, and as a result, it is possible to multifariously provide the passengers with an evacuation route from the current positions of the passengers to a safe place, thereby preventing confusion caused by an evacuation situation.

In addition, according to the present invention, it is possible to efficiently provide the evacuation route to the passengers even in a lightless tunnel or at night.

BEST MODE

Advantages and features of the present invention and methods of achieving the advantages and features will be clear with reference to exemplary embodiments described in detail below together with the accompanying drawings.

However, the present invention is not limited to exemplary embodiment disclosed herein but will be implemented in various forms. The exemplary embodiments are provided so that the present invention is completely disclosed, and a person of ordinary skilled in the art can fully understand the scope of the present invention. Therefore, the present invention will be defined only by the scope of the appended claims.

Hereinafter, a passenger evacuation direction guidance system according to an exemplary embodiment of the present invention will be described with reference to FIGS. 1 to 5. In the description of the present invention, the specific descriptions of publicly known related function or configurations will be omitted in order to prevent the specific descriptions from obscuring the subject matter of the present invention.

A passenger evacuation direction guidance system 100 according to an exemplary embodiment of the present invention is a system for guiding an evacuation direction so as to safely evacuate passengers from a disaster or an accident occurring in a train or on a traveling route of the train during a train service, and the passenger evacuation direction guidance system 100 may include an evacuation direction generation unit 10 which generates passenger evacuation direction information for passengers in the train when a disaster or an accident occurs on a traveling route of the train, and an evacuation direction display unit 20 which receives the passenger evacuation direction information generated by the evacuation direction generation unit 10 and displays a passenger evacuation direction on an object positioned at the periphery of the train.

Figure 1:
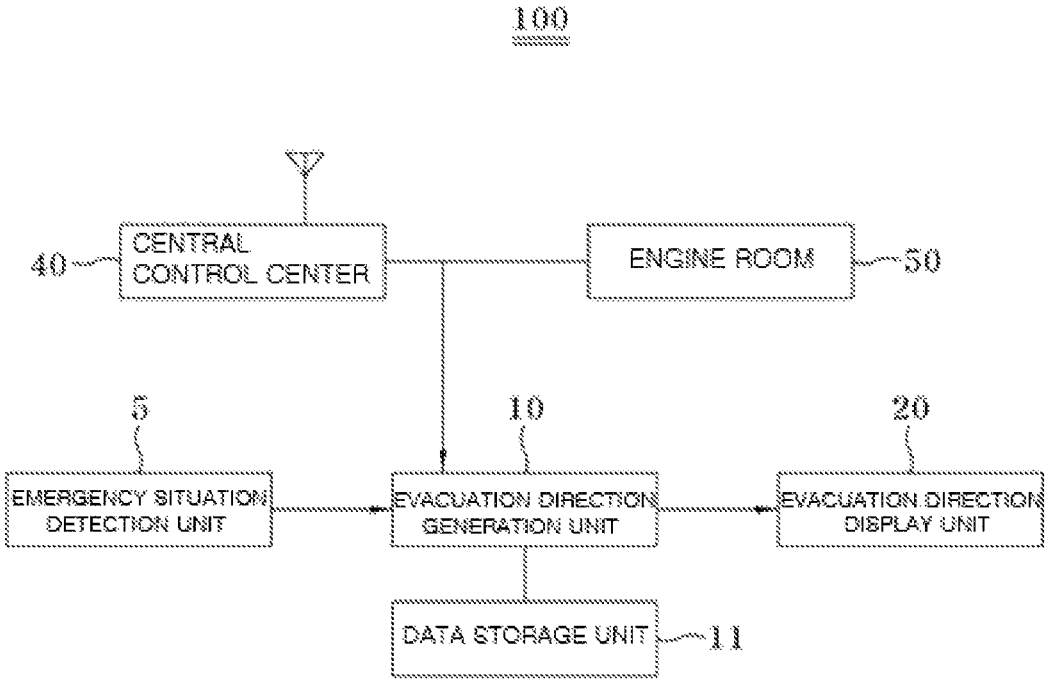
FIG. 1 is a block diagram illustrating a configuration of a passenger evacuation direction guidance system according to an exemplary embodiment of the present invention.

As illustrated in FIG. 1, the evacuation direction generation unit 10 may receive an emergency situation detection signal from an emergency situation detection unit 5 that determines the occurrence of a disaster or an accident on a traveling route of the train or in the train.

The emergency situation detection unit 5 may be implemented by a plurality of surveillance cameras, fire detecting sensors, or the like provided on the traveling route or in the train in order to detect a disaster or an accident occurring on the traveling route of the train or in the train. That is, the surveillance camera or the fire detecting sensor may detect the occurrence of a disaster or an accident on the traveling route of the train or in the train in real time, and when a disaster or an accident occurs, the surveillance camera or the fire detecting sensor may transmit an emergency situation detection signal, including position information of a disaster or accident occurrence point, to the evacuation direction generation unit 10.

For reference, in the exemplary embodiment of the present invention, it is described that a disaster or an accident occurring on the traveling route of the train may be detected by using the surveillance camera or the fire detecting sensor, but the present invention is not limited thereto, and various publicly known detection systems, or the like may be used to detect a disaster, an accident, or the like in real time. In addition, it is described that the evacuation direction generation unit 10 receives the emergency situation detection signal from the emergency situation detection unit 5, but the present invention is not limited thereto. That is, the evacuation direction generation unit 10 may receive an emergency situation detection signal from a central control center 40 or an engine room 50.

Further, the evacuation direction generation unit 10 is connected to a data storage unit 11 which stores a plurality of space databases and a plurality of passageway databases in respect to spaces and passageways provided in a station building or on the traveling route of the train so that the passengers in the train may move to a safe place such as an emergency exit while avoiding the disaster or accident occurrence point.

That is, the evacuation direction generation unit 10 may receive the position information of the disaster or accident occurrence point from any one of the emergency situation detection unit 5, the central control center 40, and the engine room 50, may extract space information and passageway information at the disaster or accident occurrence point from the data storage unit 11, and may generate evacuation direction information from the disaster or accident occurrence point to the safe place.

The evacuation direction display unit 20 receives the passenger evacuation direction information, which is generated by the evacuation direction generation unit 10 as described above, and may provide the passengers in the train with a passenger evacuation direction so that the passengers may move to the safe place.

Figure 2:
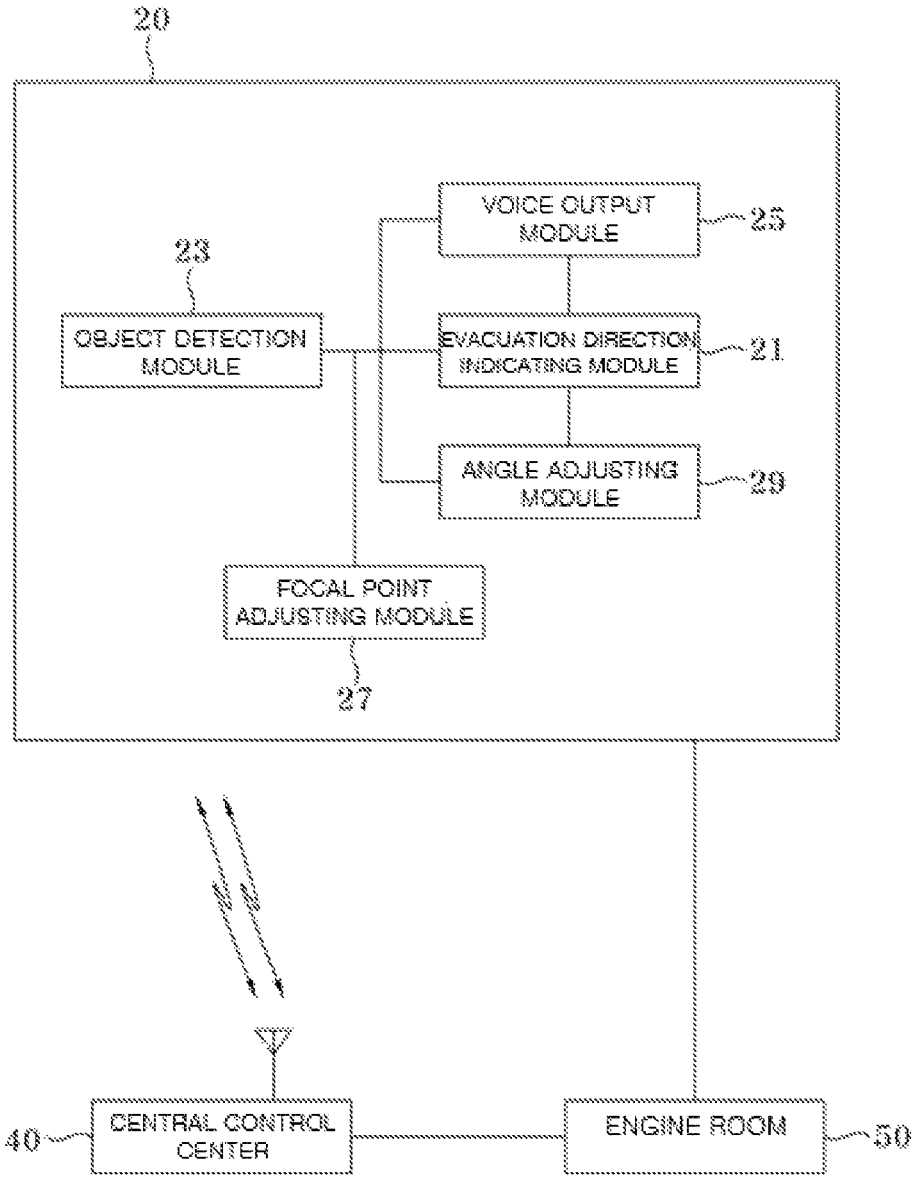
FIG. 2 is a block diagram illustrating a detailed configuration of an evacuation direction control unit according to the exemplary embodiment of the present invention.
Figure 3:
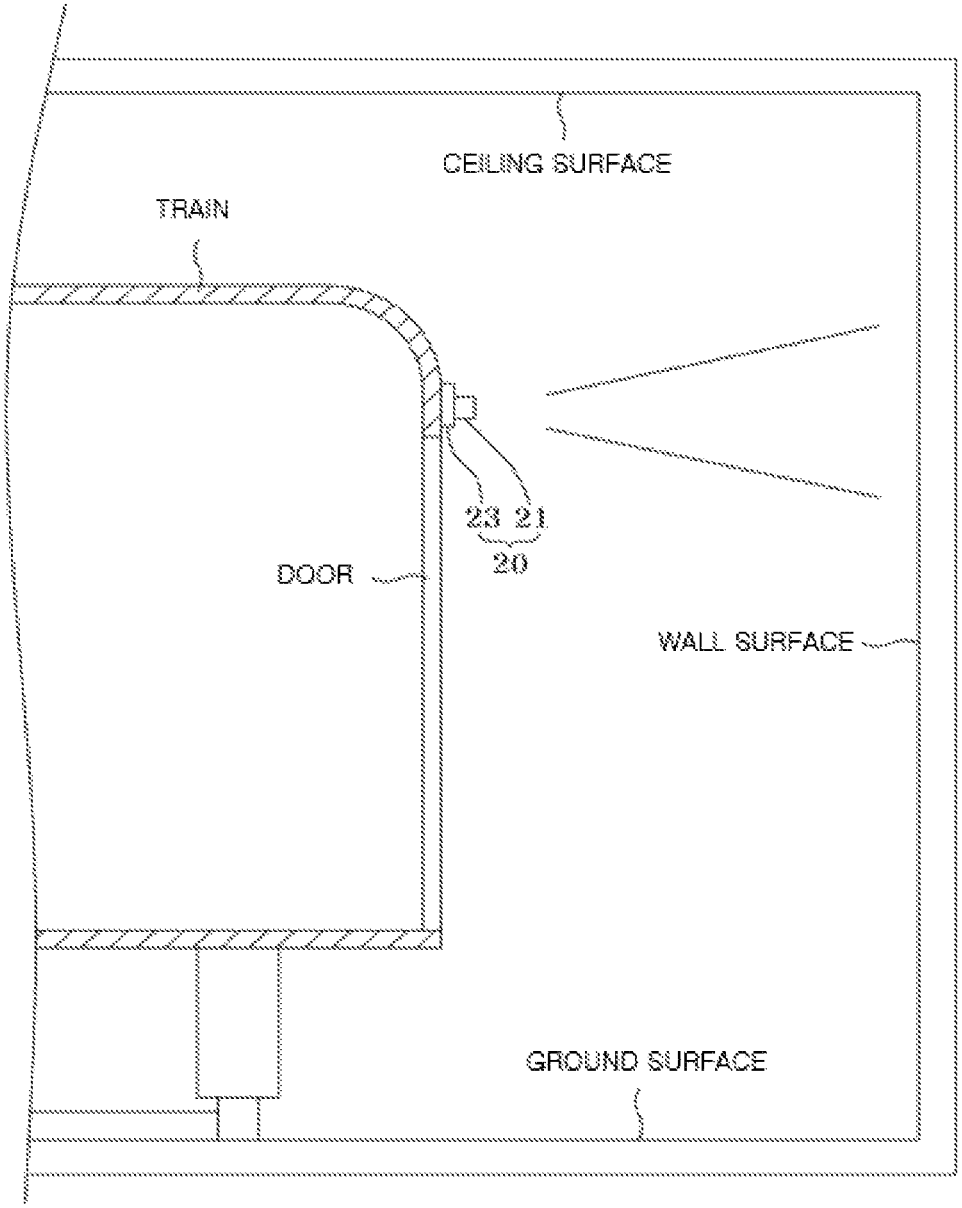
FIG. 3 is a view schematically illustrating a state in which a passenger evacuation direction is indicated on a wall surface by the evacuation direction control unit according to the exemplary embodiment of the present invention.

Further, as illustrated in FIGS. 2 and 3, the evacuation direction display unit 20 may include an evacuation direction indicating module 21 which is installed on the train and indicates the passenger evacuation direction on an object by emitting light toward the object.

The evacuation direction indicating module 21 may be installed on each of a plurality of doors provided on the train or at a position adjacent to each of the doors. The reason is that the plurality of doors is typically provided in a longitudinal direction of the train, and as a result, the passengers may exit the plurality of doors in different evacuation directions when a disaster or an accident occurs.

Therefore, the evacuation direction display unit 21 may provide the passengers, who exit each of the plurality of doors, with safe passenger evacuation directions that indicate evacuation directions which guide the passengers to places closest to safe places in consideration of the current positions of the passengers and the disaster or accident occurrence point.

Further, the evacuation direction indicating module 21 may be implemented by an imaging device such as a beam projector or a laser projector.

Therefore, the evacuation direction display unit 20 may provide the passengers, who exit each of the plurality of doors, with safe passenger evacuation directions that indicate evacuation directions which guide the passengers to places closest to safe places in consideration of the current positions of the passengers and the disaster or accident occurrence point.

Figure 4:
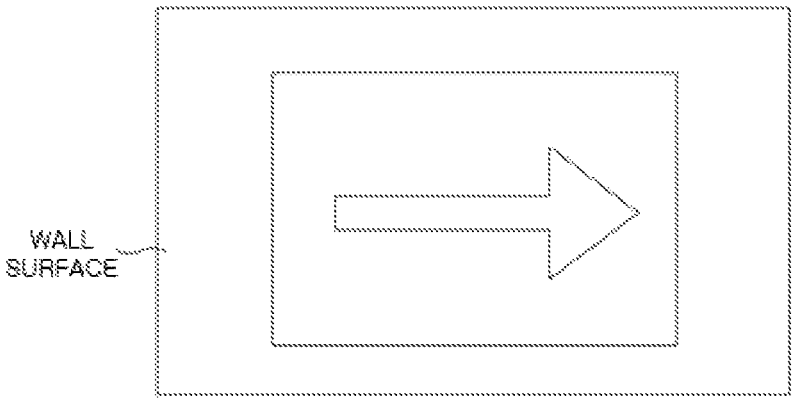
FIG. 4 is a view illustrating implemented examples of passenger evacuation direction signs outputted by an evacuation direction indicating unit according to the exemplary embodiment of the present invention.
Figure 4:
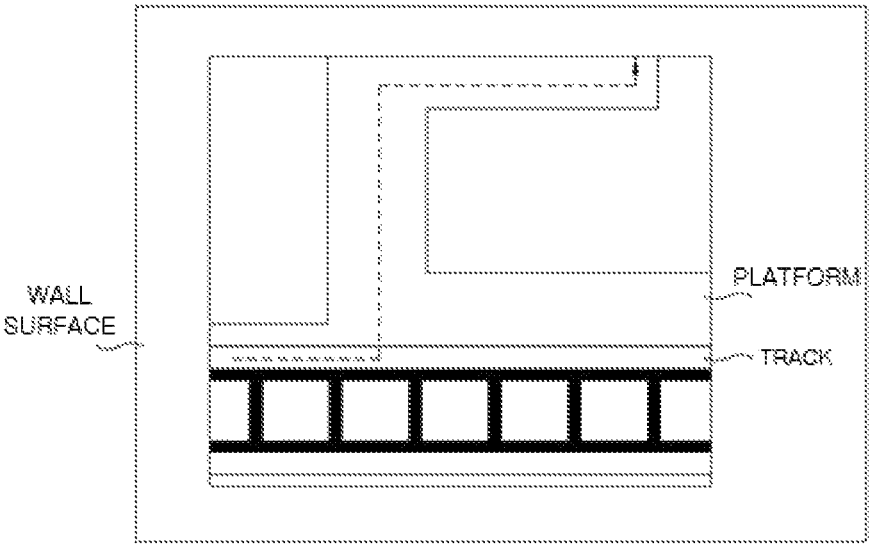
Figure 5:
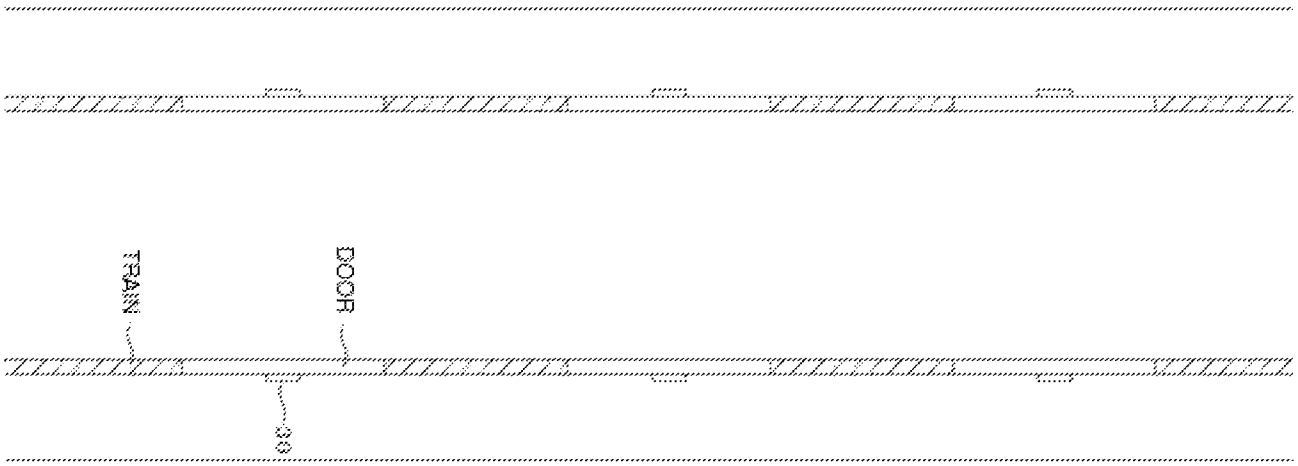
FIG. 5 is a cross-sectional view illustrating a state in which the evacuation direction control unit according to the exemplary embodiment of the present invention is provided on each door of a train, when viewed from the top side.

Further, based on the passenger evacuation direction information generated by the evacuation direction generation unit 10, the passenger evacuation direction indicated by the evacuation direction indicating module 21 may be implemented by an arrow that indicates an evacuation direction in one direction toward a safe place while avoiding the disaster or accident occurrence point, as illustrated in (a) of FIG. 4, and the passenger evacuation direction may be implemented by a route map of the disaster or accident occurrence point which indicates an evacuation route from the current positions of the passengers to the safe place by multi-directional arrows, as illustrated in (b) of FIG. 4.

Further, the evacuation direction display unit 20 may include an object detection module 23 for detecting a position of the object.

The object to be detected by the object detection module 23 may preferably be any one of a tunnel wall surface, a floor surface, and a ceiling surface on the traveling route of the train so that the passenger evacuation direction indicated by the evacuation direction indicating module 21 may be easily recognized by the passengers with the naked eye. That is, the object to be detected by the object detection module 23 serves as a screen onto which the passenger evacuation direction indicated by the evacuation direction indicating module 21 is outputted.

Further, the order of the objects to be detected by the object detection module 23 is determined according to the ability of the object of enabling the passengers to easily recognize the passenger evacuation direction indicated by the evacuation direction indicating module 21 when the passengers in the train exit through the doors to the outside of the train, and a wall surface, a floor surface, and a ceiling surface may be determined in priority order.

For example, the object to be the object detection module 23 is determined as the wall surface, the passengers, who exit through the doors, may naturally recognize the passenger evacuation direction indicated on the wall surface that faces the passengers. However, in a case in which there is no wall surface on the traveling route of the train or the wall surface is distant from the train, the object detection module 23 may detect the floor surface and the ceiling surface in the order.

For reference, the reason why the floor surface is preferentially detected than the ceiling surface is that the passengers, who exit through the doors to the outside of the train, may more easily recognize, with the naked eye, the passenger evacuation direction outputted onto the floor surface than the passenger evacuation direction outputted onto the ceiling surface.

In addition, the evacuation direction display unit 20 may further include a voice output module 25 that informs, by voice, the passengers of a position of the object onto which the passenger evacuation direction is indicated.

For example, in a case in which the evacuation direction indicating module 21 indicates the passenger evacuation direction on the wall surface detected by the object detection module 23, the voice output module 25 may output a voice that guides the passengers, who exit through the doors of the train, so as to allow the passengers to look at the wall surface.

Further, in a case in which there is no object to be detected by the object detection module 23, the object is distant from the object detection module 23, or the object cannot be detected due to a malfunction of the object detection module 23, the voice output module 25 may indicate the evacuation direction, by voice, to the passengers based on the evacuation direction information generated by the evacuation direction generation unit 10. For example, the voice output module 25 may output a voice that instructs the passengers, who exit through the doors to the outside of the train, to move to the left or right, thereby guiding the passengers to an evacuation route.

In addition, the evacuation direction display unit 20 may further include a focal point adjusting module 27 which calculates a focal length between the object and the evacuation direction indicating module 21 based on the position of the object detected by the object detection module 23, and thus adjusts clarity of the indication of the passenger evacuation direction.

The focal point adjusting module 27 prevents the passenger evacuation direction indicated on the object from being indicated on the object in a blurred state, thereby enabling the passengers, who exit through the doors of the train, to recognize the passenger evacuation direction in a clear state. If the passenger evacuation direction is indicated on the object in a blurred state, the passengers cannot accurately recognize the evacuation direction, and may suffer from a difficulty in moving to a safe place.

Further, the evacuation direction display unit 20 may further include an angle adjusting module 29 which adjusts an indication angle of the evacuation direction indicating module 21 so as to correspond to the position of the object.

To adjust the indication angle of the passenger evacuation direction outputted from the evacuation direction indicating module 21, the angle adjusting module 29 may receive the position information of the object detected by the object detection module 23, and may adjust up, down, left, and right angles of the evacuation direction indicating module 21.

For reference, the configuration in which the evacuation direction indicating module 21 is rotated in up, down, left, and right directions by the angle adjusting module 29 may be implemented by using a rotating device such as a linear motor, and because this configuration is a publicly known configuration widely used in general industrial fields, a specific description thereof will be omitted from the specification of the present invention.

Further, the evacuation direction display unit 20 may be directly controlled by a safety manager or an engineer in the central control center 40 in the station building or in the engine room 50 in the train. That is, the passenger evacuation direction may be provided to the passengers by directly controlling the evacuation direction indicating module 21 of the evacuation direction display unit 20 from the central control center 40 or the engine room 50.

The passenger evacuation direction guidance system 100 according to the exemplary embodiment of the present invention, which is configured as described above, may quickly provide a safe evacuation route to the passengers, who exit through the doors of the train when a disaster or an accident occurs on the traveling route of the train.

In addition, according to the passenger evacuation direction guidance system 100 of the present invention, the evacuation direction display unit 20 is provided at each of the doors through which the passengers exit, and as a result, it is possible to multifariously provide the passengers with an evacuation route from the current positions of the passengers to a safe place, thereby preventing confusion caused by an evacuation situation.

While the specific exemplary embodiments according to the present invention have been described above, the exemplary embodiments may be modified to various exemplary embodiments without departing from the scope of the present invention. Therefore, the scope of the present invention should not be limited to the described exemplary embodiments, and should be defined by not only the claims to be described below, but also equivalents to the claims.

INDUSTRIAL APPLICABILITY

The present invention may be used for a passenger safety management system in transportation industries such as a subway industry or a railway industry for transporting a larger number of passengers.

The invention claimed is:

1. A passenger evacuation direction guidance system comprising:

an evacuation direction generation unit which generates passenger evacuation direction information for passengers in a train when a disaster or an accident occurs on a traveling route of the train; and an evacuation direction display unit which receives the passenger evacuation direction information generated by the evacuation direction generation unit, and displays a passenger evacuation direction on an object positioned at the periphery of the train, wherein the evacuation direction display unit includes an object detection module for detecting a position of the object and a focal point adjusting module which calculates a focal length between the object and the evacuation direction indicating module based on the position of the object detected by the object detection module, and adjusts clarity of the indication of the passenger evacuation direction based on the focal length between the object and the evacuation direction indicating module.

2. The passenger evacuation direction guidance system according to claim 1, wherein the object is at least one of a wall surface, a floor surface, and a ceiling surface positioned at the periphery of the train.

3. The passenger evacuation direction guidance system according to claim 1, wherein the evacuation direction display unit includes an evacuation direction indicating module which is installed on the train and indicates the passenger evacuation direction on the object by emitting light toward the object.

4. The passenger evacuation direction guidance system according to claim 3, wherein the evacuation direction indicating module is installed on a door of the train or at a position adjacent to the door.

5. The passenger evacuation direction guidance system according to claim 3, wherein the evacuation direction display unit further includes an angle adjusting module which adjusts an indication angle of the evacuation direction indicating module in accordance with a position of the object.

6. The passenger evacuation direction guidance system according to claim 1, wherein the passenger evacuation direction is indicated by an arrow indicating the evacuation direction or a route map indicating an evacuation route from the current positions of the passengers to a safe place.

7. The passenger evacuation direction guidance system according to claim 3, wherein the evacuation direction display unit further includes a voice output module which informs the passengers of the position of the object by voice, and the voice output module informs the passengers of the passenger evacuation direction by voice when there is no object on which the passenger evacuation direction is indicated or when the object is not appropriate.

8. The passenger evacuation direction guidance system according to claim 1, wherein the order of the object to be detected by the object detection module is first a wall surface, second a floor surface, and third a ceiling surface according to the ability of the object of enabling the passengers to easily recognize the passenger evacuation direction indicated by the evacuation direction indicating module when the passengers in the train exit through the doors to the outside of the train.

* * * * *